US005307987A

United States Patent [19]

Roccaforte

[11] Patent Number: 5,307,987

[45] Date of Patent: May 3, 1994

[54] HOODED CARTON

[75] Inventor: Harry I. Roccaforte, Chicago, Ill.

[73] Assignee: Waldorf Corporation, St. Paul, Minn.

[21] Appl. No.: 986,782

[22] Filed: Dec. 8, 1992

[51] Int. Cl.[5] ..... B65D 5/54; B65D 5/66

[52] U.S. Cl. ..... 229/225; 229/117.13; 229/131; 229/145; 229/930

[58] Field of Search ..... 229/117.12, 117.13, 229/117.22, 131, 225, 145, 160.1, 905, DIG. 4; 206/268, 273; 220/443

[56] References Cited

U.S. PATENT DOCUMENTS

| | | | |
|---|---|---|---|
| 1,218,872 | 3/1917 | Lafore | 229/DIG. 4 |
| 2,276,363 | 3/1942 | Zalkind | 229/DIG. 4 |
| 2,361,597 | 10/1944 | Buttery | 229/160.1 |
| 2,473,055 | 6/1949 | Guyer | 229/160.1 |
| 2,795,367 | 6/1957 | Feldman et al. . | |
| 2,795,368 | 6/1957 | Caster et al. . | |
| 2,795,369 | 6/1957 | Caster et al. . | |
| 2,802,616 | 8/1957 | Caster et al. . | |
| 2,881,967 | 4/1959 | Ringler | 229/160.1 |
| 2,889,104 | 6/1959 | Caster et al. . | |
| 2,955,739 | 10/1960 | Collura | 229/117.13 |
| 3,000,548 | 9/1961 | Frazier . | |
| 3,015,432 | 1/1962 | Tyrseck . | |
| 3,019,959 | 2/1962 | Skowronski . | |
| 3,078,030 | 2/1963 | Gorton . | |
| 3,252,651 | 5/1966 | Holmes | 229/145 |
| 3,338,505 | 8/1967 | Hughes . | |
| 3,459,328 | 8/1969 | Rowley . | |
| 3,873,017 | 3/1975 | Blatt | 220/443 |
| 3,910,487 | 10/1975 | Jaeschke . | |
| 3,963,173 | 6/1976 | Stone | 229/145 |
| 4,048,052 | 9/1977 | Tolaas | 229/145 |
| 4,121,757 | 10/1978 | Hamlin . | |
| 4,215,783 | 8/1980 | Vanderlugt, Jr. | 229/145 |
| 4,268,555 | 5/1981 | Kantz | 229/DIG. 4 |
| 4,284,197 | 8/1981 | Meyers | 229/145 |
| 4,378,905 | 4/1983 | Roccaforte . | |
| 4,421,236 | 12/1983 | Lowe | 229/145 |
| 4,546,914 | 10/1985 | Roccaforte | 229/117.13 |
| 4,693,413 | 9/1987 | McFarland et al. | 229/DIG. 4 |
| 4,863,035 | 9/1989 | Hiroshima . | |
| 4,986,420 | 1/1991 | Gunn et al. . | |
| 5,033,622 | 7/1991 | DePasquale et al. . | |
| 5,154,343 | 10/1992 | Stone | 229/160.1 |
| 5,161,734 | 11/1992 | Ruehl et al. . | |

FOREIGN PATENT DOCUMENTS

| | | | |
|---|---|---|---|
| 443930 | 8/1991 | European Pat. Off. | 229/117.22 |
| 2485486 | 12/1981 | France | 229/225 |
| 2653747 | 5/1991 | France | 229/117.22 |
| 9014278 | 11/1990 | PCT Int'l Appl. | 229/160.1 |
| 1542461 | 3/1979 | United Kingdom | 229/131 |

*Primary Examiner*—Gary E. Elkins
*Attorney, Agent, or Firm*—Dorsey & Whitney

[57] ABSTRACT

The present invention is a recloseable hooded carton, particularly useful for containing granular material such as soap powder or the like. The carton is generally rectangular, having front and rear walls, opposed side walls, a closed bottom structure, and a top opening structure including a recloseable hood. An integral handle is provided for carrying the carton before and after opening the hood. A blank for forming the present invention is encompassed.

39 Claims, 11 Drawing Sheets

HOODED CARTON

TECHNICAL FIELD

The present invention relates to cartons for particulate or granular products. More particularly, the present invention relates to a recloseable hooded carton for containing products having a particulate consistency, wherein the carton opening structure is a hood or flip-top, and wherein the carton has an integral carrying handle.

BACKGROUND OF THE INVENTION

Hooded cartons having a hinged, flip-top cover are well known and generally, although not exclusively, used to contain fungible material, such as soap powder or ice cream. U.S. Pat. Nos. 3,078,030 (to Gorton), 3,283,991 (to Hughes) and 5,033,622 (to DePasquale et al.) are fairly representative of this type of carton in that each of the patents discloses a box or carton having a cover or hood with a skirt. The carton disclosed in the Gorton patent is intended to be opened and closed a number of times, and the patent refers to flip-top boxes, such as cigarette boxes, that may have an additional piece of paperboard secured to the upper front portion of the box to engage the top when closed. The Gorton patent also notes that such boxes may use inner and outer boxes to achieve box strength and to aid in retaining the top in its closed position. The DePasquale et al. and Hughes patents disclose examples of the well-known "ice cream" cartons. None of the aforementioned Hughes, Gorton and DePasquale et al. patents discloses handles for carrying the subject cartons.

U.S. Pat. Nos. 3,910,487 (to Jaeschke) and 4,048,052 (to Tolaas) disclose cartons having a hinged, flip-top cover movable back into a closed position after being opened. The Jaeschke carton includes an extended glue flap positioned against the inside of the front panel to serve as a liner panel. The glue flap is foldably connected to the bottom panel of the carton, but according to Jaeschke, a separate panel could be used to form the liner. Neither of the Jaeschke or Tolaas patents discloses a carrying handle.

Cartons with integral carrying handles are disclosed in U.S. Pat. Nos. 4,378,905 and 4,546,914 (both to Roccaforte, the inventor of the present invention). The handle disclosed in U.S. Pat. No. 4,546,914 is a reinforced 3-ply elongated handle panel formed from a portion of the outer top panel of the carton. U.S. Pat. No. 2,995,739 (to Collura) discloses a somewhat similar carton and handle, but none of the Collura patent or the two Roccaforte patents discloses or suggests how an integral strap-like handle could be integrated with a hooded or flip-top carton.

U.S. Pat. No. 4,986,420 (to Gunn et al.) discloses a hooded package with handle. The handle is a separate flat strap-like handle having an arrowhead shaped tip at each end. It is attached to the package by inserting the tips into openings in the side walls of the package. The package requires a liner to prevent the contents from leaking out at the point where the handle is attached, and also to provide a structure for the hood or lid to rest on when closed. In one embodiment of the package, the liner is formed by the flaps of the outer body of the package, and thus, there is no need to attach a separate liner. Although the handle disclosed by Gunn et al. can be used to carry the package after the hood is opened, the handle is not formed integrally with the package and the package requires multi-ply side panels to prevent the contents from leaking out of the package.

The above-noted patents disclose improvements in recloseable hooded or flip-top cartons, but none discloses a hooded carton with an integral handle formed from the same single-piece blank from which the carton is formed. The Gunn et al. patent suggests the desirability of providing hooded cartons with a handle, but the Gunn et al. handle is a separate strap handle attached to the package after the package is formed. As pointed out in the Gunn et al. patent, discretely formed separate handles, their attaching elements, and the process of attaching such handles are expensive. Additionally, the Gunn et al. package and handle arrangement requires a liner to maintain the integrity of the package, thereby increasing the consumption of expensive paperboard or other stock material and complicating the fabrication process.

A recloseable hooded carton for containing particulate or granular products which is easy to open and reclose securely, yet which includes an integral carrying handle and can be produced efficiently and inexpensively, would be a decided improvement over the hooded containers known at present.

SUMMARY OF THE INVENTION

The present invention is an improved hooded recloseable carton, particularly useful for containing particulate or granular material, such as detergent soap powder or the like. The carton is generally in the form of a rectangular box, having opposed parallel front and rear walls, opposed parallel, multi-layer side walls and a closed bottom end structure forming a carton body, and a top end opening structure comprising a flip-top recloseable hood. The flip-top hood of the carton is formed by an inside main hood panel foldably connected to the carton body at a hinge line lying in the plane of the inside main hood panel and spaced forwardly from the foldable connection between the inside main hood panel and the rear wall. The inside main hood panel includes a hinge flange. An inside hood closure tab is attached at each side of the inside hood panel. A frangible umbilical section connects a hood retaining and supporting wall panel to the hood panel. Side hood retaining wall panels are foldably connected at opposite sides of the retaining wall panel. An outer hood panel is foldably connected to the front wall and is designed to overlie coextensively a portion of the inside hood panel. The outer hood panel has a free edge and a cut line parallel to the free edge. Two hood skirt flaps are foldably connected to opposite sides of the outer hood panel. The carton is provided with an opening tear strip extending completely across the front and outermost layer of the side walls. The area between the tear strip and the top of the carton (the top wall of the hood, comprised of the inside and outer hood panels) provides a hood skirt comprising front and side skirt panels.

A feature of the present invention for certain embodiments is an integral carrying handle designed for use both before and after the hood is opened. In such embodiments, the inside hood panel includes a flange defined by a partial hinge cut, with delamination regions at the end thereof. A cut line, including optional nicks, is made parallel and closely adjacent to the free edge of the outer hood panel, thereby defining a handle strip. When the blank is erected into the carton of the present invention, the hinge cut and the cut line are aligned so that the handle strip overlies the flange and the carton can be lifted and carried after the hood is opened. A deformable region to facilitate the use of the handle is created in the rear wall, specifically at the foldable connection between the inside hood panel and the rear wall, by providing a curved fold score line near the top of the rear wall.

In another embodiment, the handle is formed by providing an outer hood forming panel that only partially overlies the inside hood panel. In this embodiment, die-cuts and perforations are applied to the outer hood panel to enable a strip to be separated partially from the outer hood panel to form a strip-like handle extending across the top of the carton from side-to-side. Yet another embodiment contemplates a handleless carton wherein the outer hood panel is replaced by an outer hood gluing panel or flap, and wherein the hood is hinged to the carton directly along the foldable connection between the inside hood panel and the rear wall.

A further feature of the present invention relates to an improved overlapping fold score line structure, and with specific regard to the present invention, to the overlapping or overlaid fold score lines forming articulations or hinges in the umbilical section. Broadly, a first inside two-sided fold score line is made by making two one-sided scores in the paperboard stock material. That is, there are two generally parallel score rules that are sufficiently spaced from each other so that the paperboard is pressed down at two discrete points, yet close enough to form a relieved or depressed region therebetween. The two-sided fold score line results in a wider shape which provides space for a second outside score to expand into when the overlapping scores are folded to make a corner, thereby preventing the outside fold score line from expanding outwardly and rupturing. This feature enables overlapping fold score lines even when the layers of stock material bearing the score lines are connected to each other on both sides of such score lines.

A further related aspect of the present invention relates to a method of forming score lines in a double or multiple layer structure to reduce or eliminate rupturing along the fold line when the structure is folded or articulated. Specifically, such method includes forming a first score line in one of the layers, forming a second score line of increased width in a second layer and adhesively joining the layers so that the first and second score lines are aligned or overlay one another.

Another alternative embodiment encompassed by the present invention is one wherein the carton is comprised of two pieces; a blank and a hood retaining and supporting wall panel extending around the carton opening.

Flat blanks that may be folded and secured into the preceding carton configurations are encompassed in the present invention. The blanks may be formed from paperboard of any caliper, or other suitable material.

Accordingly, it is an object of the present invention to provide a recloseable hooded carton having an integral handle and a hood with a hood skirt formed by a portion of the front and side walls of the carton.

Another object of the present invention is to provide a recloseable hooded carton for containing granular materials, such as soap powder, that is easy to open, recloses securely, and includes an integrally formed carrying handle for use before and after the carton is opened.

Another object of the present invention is to provide a recloseable hooded carton that is easy to reopen and reclose securely, includes an integrally formed carrying handle, yet protects the contents and prevents leakage without requiring an expensive "box within a box" liner arrangement.

Still another object of the present invention is to provide a durable and convenient recloseable hooded carton for providing repeated access to the contents, yet a carton that can be manufactured, glued and erected efficiently, resulting in a less expensive carton and conserving natural resources.

A further object of the present invention is to provide an improved overlapping fold score line structure which reduces or eliminates rupturing of the outside fold score line.

A still further object of the present invention is to provide a method for forming fold score lines in a double or multiple layer structure to reduce or eliminate rupturing along the fold score line when the structure is folded or articulated.

Other objects and advantages of the present invention will become more fully apparent and understood with reference to the following specification and to the appended drawings and claims.

DETAILED DESCRIPTION OF THE PREFERRED EMBODIMENT

Figure 6:
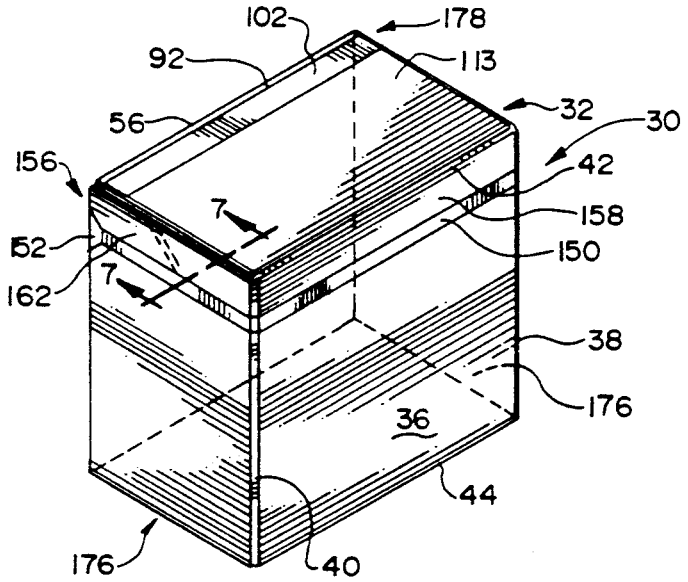
FIG. 6 is a perspective view of an erected carton embodiment of FIG. 1.

As depicted in FIG. 6, a fully erected preferred embodiment carton 30 in accordance with the present invention is a generally tubular carton with a recloseable, flip-top hooded top end structure 32. The carton has a generally rectangular cross-section and an unobstructed contents containing cavity.

Figure 1:
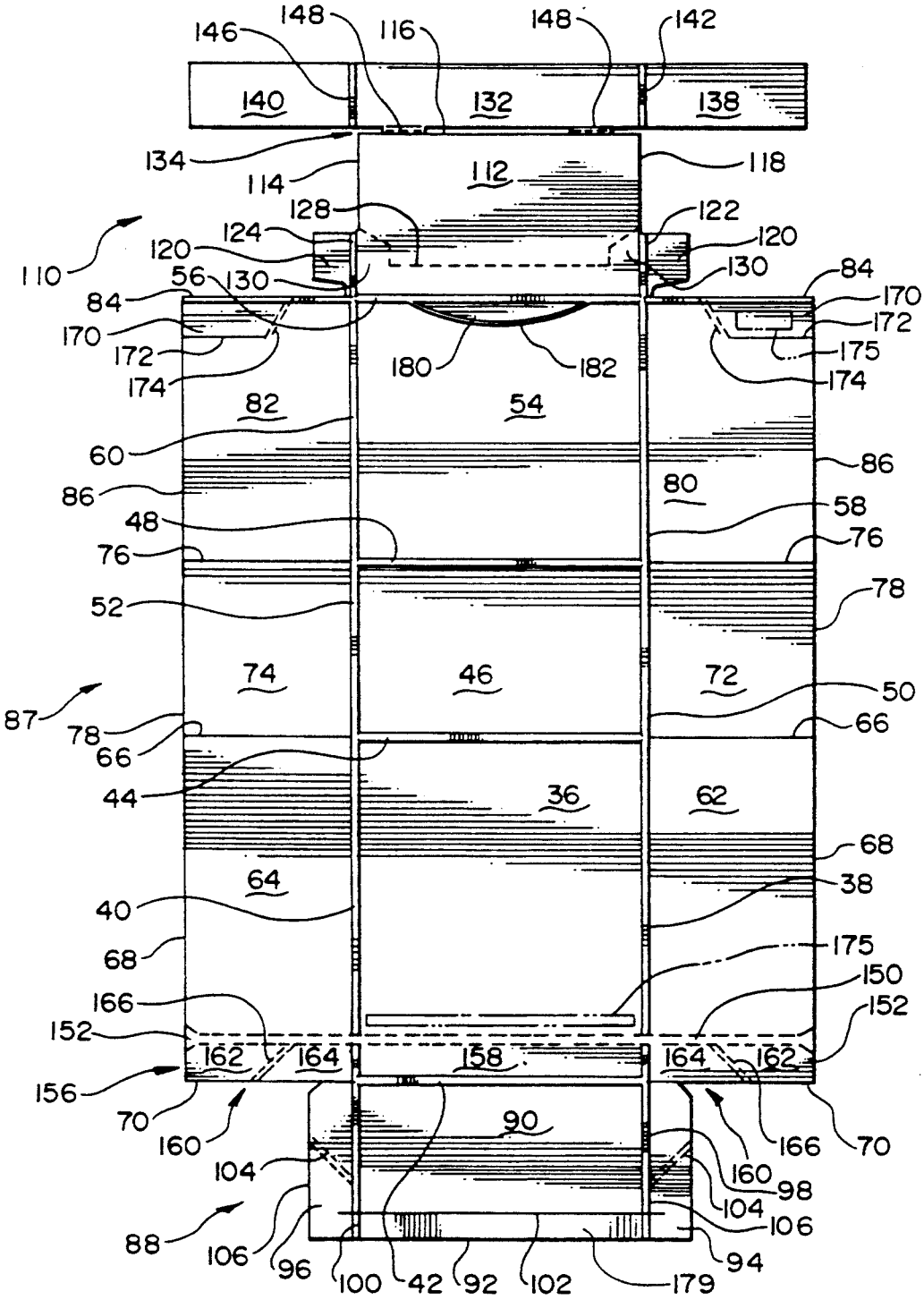
FIG. 1 is a top plan view of the inside surface of the blank from which the carton of the preferred embodiment of the present invention is formed, and depicts the die-cut profile thereof.

FIG. 1 depicts the inside surface of a single-piece, flat blank 34 for forming, in accordance with the present invention, the carton 30. In all of the drawings, double lines indicate scores used to form fold lines and single solid lines or single dashed lines indicate cuts, perforated lines, weakened lines or free edges, except where otherwise indicated.

The blank 34 has a generally rectangular front wall panel 36 having two pairs of opposed, generally parallel edges defined by fold lines 38,40 and 42,44. A bottom wall panel 46 is foldably connected to the front wall panel 36 along the fold line 44. The bottom wall panel is further defined by an opposed generally parallel fold line 48 and two parallel opposed fold lines 50,52 generally perpendicular to the fold lines 44,48. A rear wall panel 54 is foldably connected to the bottom wall panel along the fold line 48 and is further defined by fold lines 56,58,60. The side edge forming fold lines 38,50,58, are generally collinear, as are the fold lines 40,52,60.

A pair of major outermost side wall forming panels 62,64 is foldably connected to the front wall panel 36 at opposed, parallel fold lines 38,40, respectively. Each outermost side wall forming panel 62,64 includes orthogonal free cut edges 66,68,70. A pair of minor innermost side wall forming flaps 72,74 is foldably connected to the bottom wall panel 46 at fold lines 50,52, respectively. The innermost side wall forming flaps 72,74 are further defined by free cut edges 66,76, 78, with free edges 78 being parallel to the fold lines 50,52. A pair of major inside side wall forming panels 80,82 are foldably connected to the rear wall panel 54 at fold lines 58,60, respectively, and are further defined by orthogonal free cut edges 84, 86 and 76.

With continued reference to FIG. 1, the blank 34 includes an outer hood forming group 88 at one end of the generally central portion 87. The group 88 includes an outermost, central main hood forming top wall panel 90 foldably connected to the front wall panel 36 along the fold line 42. The hood forming panel 90 has a free edge 92 opposite and parallel to the fold line 42. The group 88 also includes a pair of hood skirt flaps 94,96 foldably coupled to the hood forming panel 90 along fold lines 98,100, respectively. The fold lines 98,100 are perpendicular to the fold line 42 and the free edge 92, and are collinear with fold lines 38,50,58 and 40,52,60. A single straight continuous cut line 102 is cut through the central panel 90 and extends across fold lines 98,100 into the skirt flaps 94,96. The cut line 102 is generally parallel to the free edge 92 and crosses the fold lines 98,100 at a right angle. Each flap 94,96 carries a generally medial angled set of weakened lines 104 formed by a series of perforations or cuts; the lines 104 extend from the free edges 106 of the skirt flaps 94,96 to the fold lines 98,100.

At the opposite end of the generally central portion 87 of the blank 34, the blank 34 includes an inner hood forming group, indicated generally at 110. The inner group 110 includes a generally central inside hood panel 112 having substantially the same surface area as the outermost central panel 90. The inside panel 112 is foldably coupled to the rear wall panel 54 along the fold line 56. The fold line 56 forms one edge of the panel 112, the other edges being substantially free edges 114,116,118. Side edges 114,118 are inset slightly inside the collinear fold lines 40,52,60 and 38,50,58, respectively. The inside hood panel 112 carries a pair of flange tabs 120, one foldably connected to the inside hood panel 112 along free edge 118 at a fold line 122 and the other tab 120 being foldably coupled to the hood panel 112 along edge 114 at a fold line 124. The inside hood panel 112 includes a hinge support flange forming area 126. The hinge flange area 126 is defined by a cut line 128 partially cut through the material of the blank 34 generally parallel to the fold line 56. At each end of the cut line 128, the hinge flange area 126 is expanded into delamination areas 130. The delamination areas 130 extend the hinge flange area 126 generally toward the center of the inside hood panel 112 along the side edges 114, 118 to an extent roughly equal to the width of the flange tabs 120 whereby the surface area of each delamination area 130 and tab 120 is approximately equal.

A retaining wall panel 132 is releasably and foldably coupled to the inside hood forming panel 112 along the free edge 116 thereof at an umbilical region 134. Two floating side retaining wall panels 138,140 are foldably coupled to the front retaining wall panel 132 at parallel fold lines 142,146, respectively. The retaining wall panel 132 is releasably coupled to the inside hood forming panel 112 along edge 116 by a pair of frangible perforated articulating hinges 148 formed by a two one-sided score line that is relatively wider, approximately twice as wide, as the remainder of the scored fold lines depicted in FIG. 1.

With continued reference to FIG. 1, a bidirectional tear strip 150 is scored into the front wall panel 36 and the major outermost side wall forming panels 62,64 adjacent the free edges 70 and the fold line 42. The parallel cut score lines forming the tear strip 150 are continuous cuts in the outer surface of the blank 34, extending only partially through the thickness of the blank 34. Adjacent the free edges 68 of the outermost side wall forming panels 62, 64, the cut score lines forming the tear strip 150 diverge and are cut entirely through the blank 34 to form enlarged tab ends 152 for grasping and removing the tear strip 150. Either tab 152 may be manipulated or lifted initially to begin removing the tear strip 150. A reinforcing strip of suitable material (not depicted) may be aligned with and attached to the tear strip 150 to reinforce it and to facilitate tearing it free to open the carton 30 of the present invention.

A hood skirt 156 comprising part of the outer hood forming group 88 is formed by portions of the front wall panel 36 and the major outermost side wall forming panels 62, 64 and is positioned between the tear strip 150 and the free edges 70 and fold line 42. The hood skirt 156 includes a front central skirt flap 158 and two side skirt flaps 160 foldably connected to the front flap 158. Each side skirt flap 160 is split or divided into a hood stop portion 162 and a secured portion 164 by weakened lines 166, each of which intersects the tear strip 150 and the free edges 70 at an angle.

Additional components of the hood skirt 156 include breakaway portions 170 of the inside side wall forming panels 80, 82. Each breakaway portion 170 is formed by a cut line 172 generally parallel to the free edges 76, 84 of the panels 80, 82, and an angled line of weakness 174 extending at angle from the end of the cut line 172 to the free edge 84 of the respective inside side wall forming panels 80, 82. The angled lines of weakness 166 and lines of weakness 174 are angled equally with respect to horizontal, and the breakaway portions 170 have substantially the same surface area as the hood stop portions 162.

the blank 34 is provided with an appropriate pattern of adhesive or gluing regions (represented by such regions depicted in phantom at 175) formed by applying suitable adhesives to the blank 34 in those areas of the blank 34 that need to be secured to each other to form the carton 30 of the present invention as set forth below. Any required or desired pattern may be used, as can any suitable adhesive or method of adhering parts of the blank 34 to each other.

Figure 2:
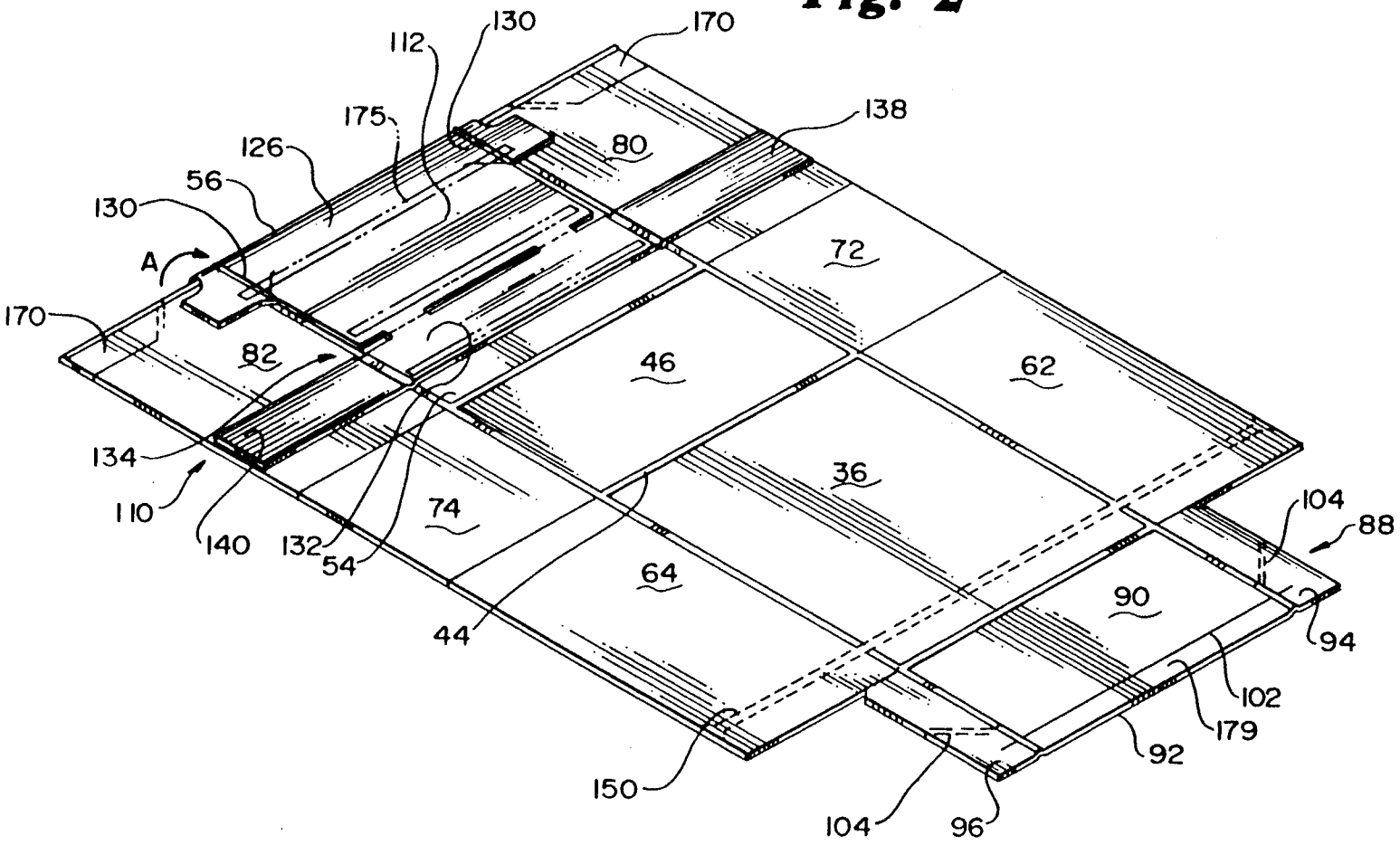
FIG. 2 is a perspective view of the blank depicting an initial step in the gluing sequence of the carton embodiment of FIG. 1.
Figure 3:
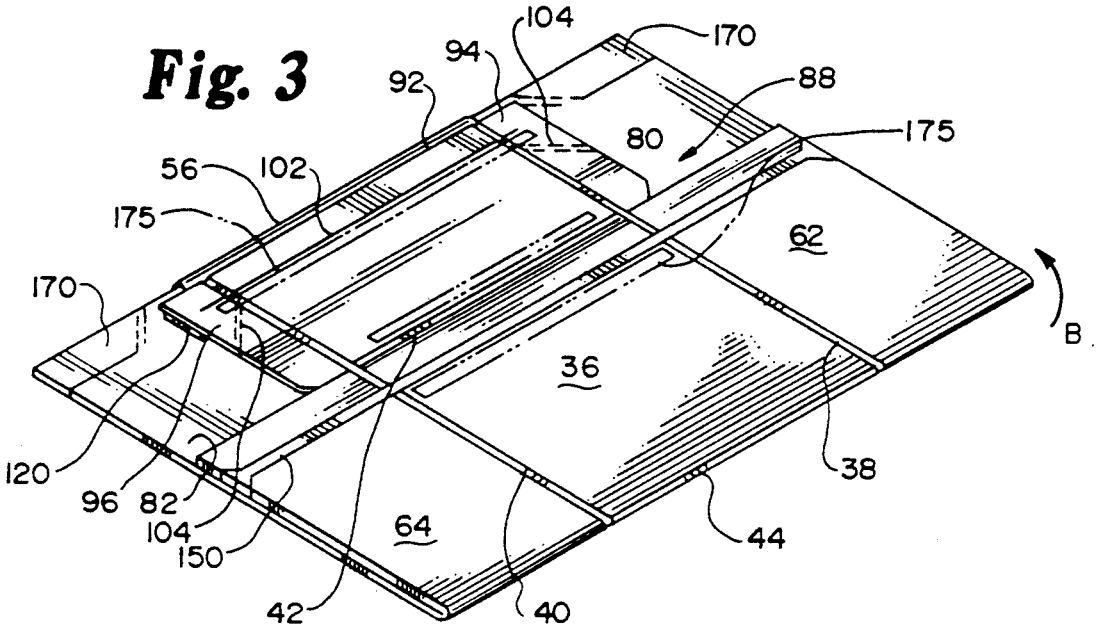
FIG. 3 is a perspective view depicting another step in the gluing sequence.

Referring to FIGS. 2-6, the folding erection of the blank 34 of the present invention into the fully formed carton 30 (FIG. 6) of the present invention is depicted. FIG. 2 depicts an initial step in the gluing process wherein the inner hood forming group 110, including retaining wall panel 132 and umbilical region 134, is folded about the fold line 56 in the direction of arrow A until it is immediately adjacent and parallel to the rear wall panel 54 and the two inside side wall forming panels 80, 82. Referring to FIG. 3, the blank 34 is then folded about fold line 44 in the direction of B until the outer hood group 88 is overlying the previously folded inner group 110. In the position depicted in FIG. 3, the free edge 92 is substantially aligned with the fold line 56. The blank 34 may be secured (by adhesive areas 175) and shipped in this condition to a purchaser.

Figure 4:
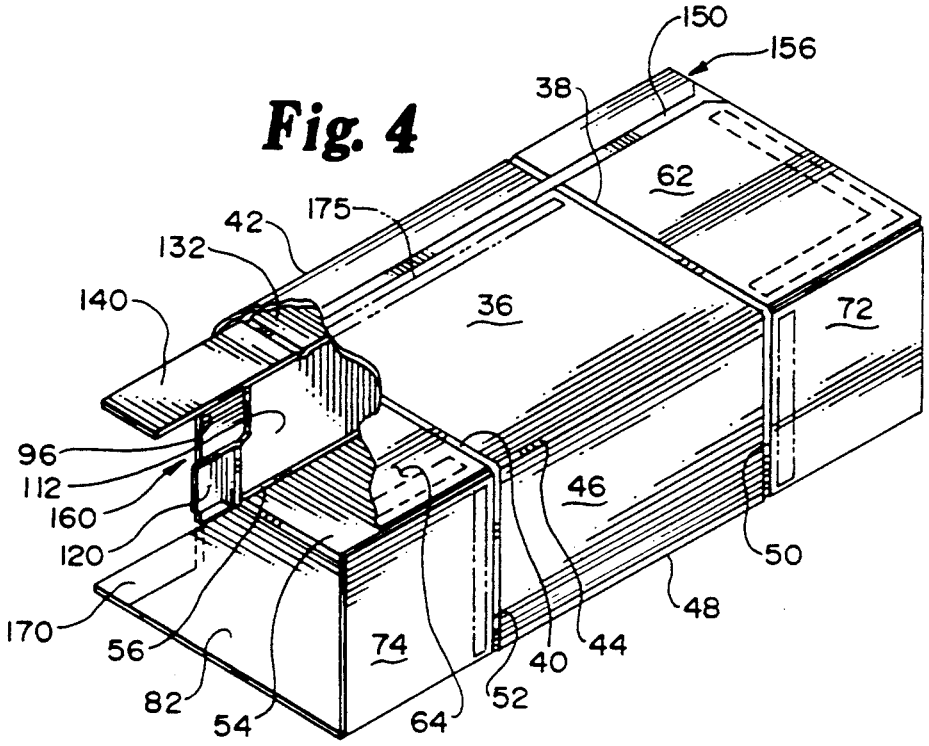
FIG. 4 is a perspective view, with parts cut away, of a step in the erection sequence.

FIG. 4 depicts the tubing of the blank 34, a subsequent step following from the condition of the blank 34 depicted in FIG. 3, wherein the blank 34 is flat, with portions overlaid and adhered. The blank 34 is tubed into the open-sided configuration depicted in FIG. 4, by folding about fold lines 42, 44, 48, 56 and hinges 148, which underlie the fold line 42 in FIGS. 3 and 4, until the front and rear wall panels 36, 54, respectively, are parallel. The hood 32 (FIG. 6) has a top wall 113 formed of the overlaid panels 90, 112.

Figure 5:
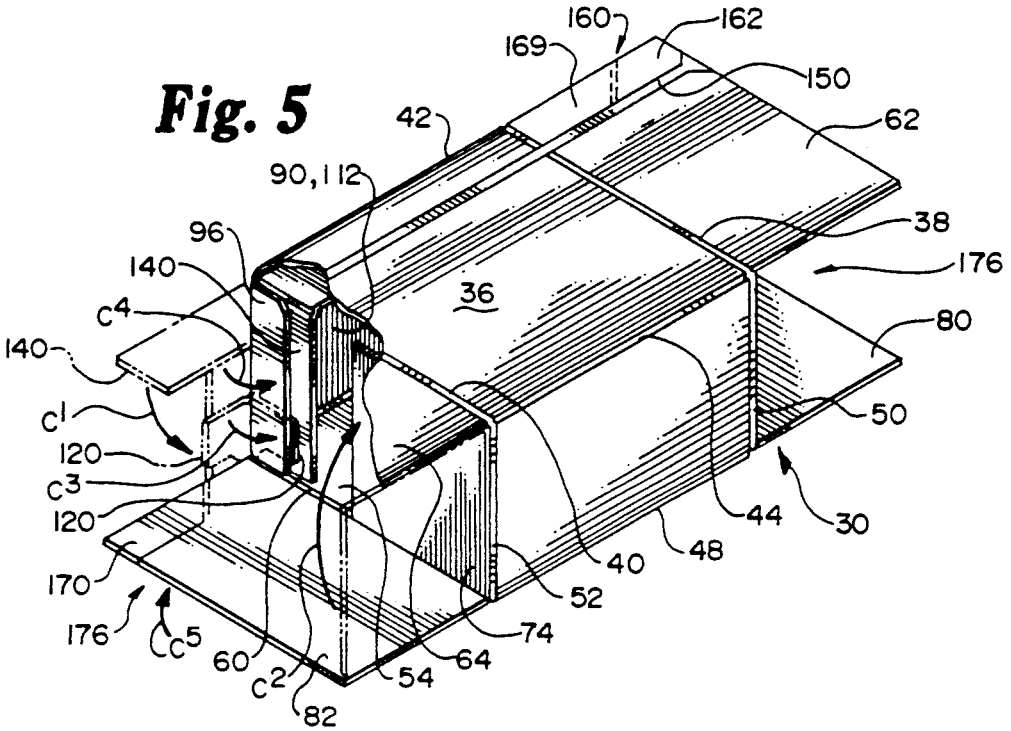
FIG. 5 is a perspective view, with parts cut away, depicting the folding sequence of the sidewall panels of the carton embodiment of FIG. 1.

As depicted in FIG. 5, both of the opposed, multi-layered side walls 176 of the carton 30 are formed by sequentially folding in the various side wall forming panels as indicated by the arrows in FIG. 5. More specifically, the floating retaining wall panels 138, 140 are folded inwardly in the direction of arrow $C^1$ until they are perpendicular with the front, rear, and top walls 36, 54 and 113, respectively, of the carton 30. Simultaneously, the bottom innermost side forming panels 72, 74 may be folded inwardly and upwardly (arrow $C^2$) until coplanar with the flaps 138, 140. Next, the flange tabs 120, which are adhered to panels 94, 96 and 90, are folded inwardly at the same time in the direction of arrow $C^3$ to overlie the floating retaining wall panels 138, 140. Next, the inside side wall forming panels 80, 82 are folded upwardly in the direction of arrow $C^5$ until they overlie all the previously folded flaps, tabs and panels and are generally perpendicular with respect to the front, rear and bottom walls 36, 54, 46 of the carton 30. Finally, the outermost side wall panels 62, 64 are folded about fold lines 38, 40 to overlie the previously folded panels, tabs and flaps. Thus, the multi-layered side walls, indicated generally at 176 in FIG. 6, of the carton 30 are formed.

Figure 7:
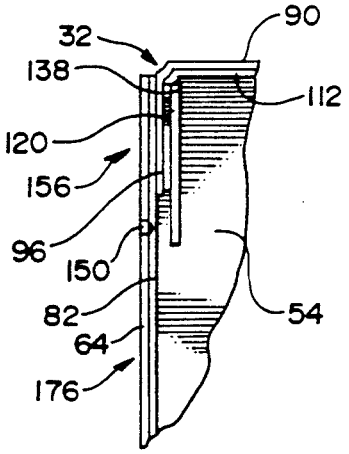
FIG. 7 is a sectional view taken along line 7—7 of FIG. 6.
Figure 9:
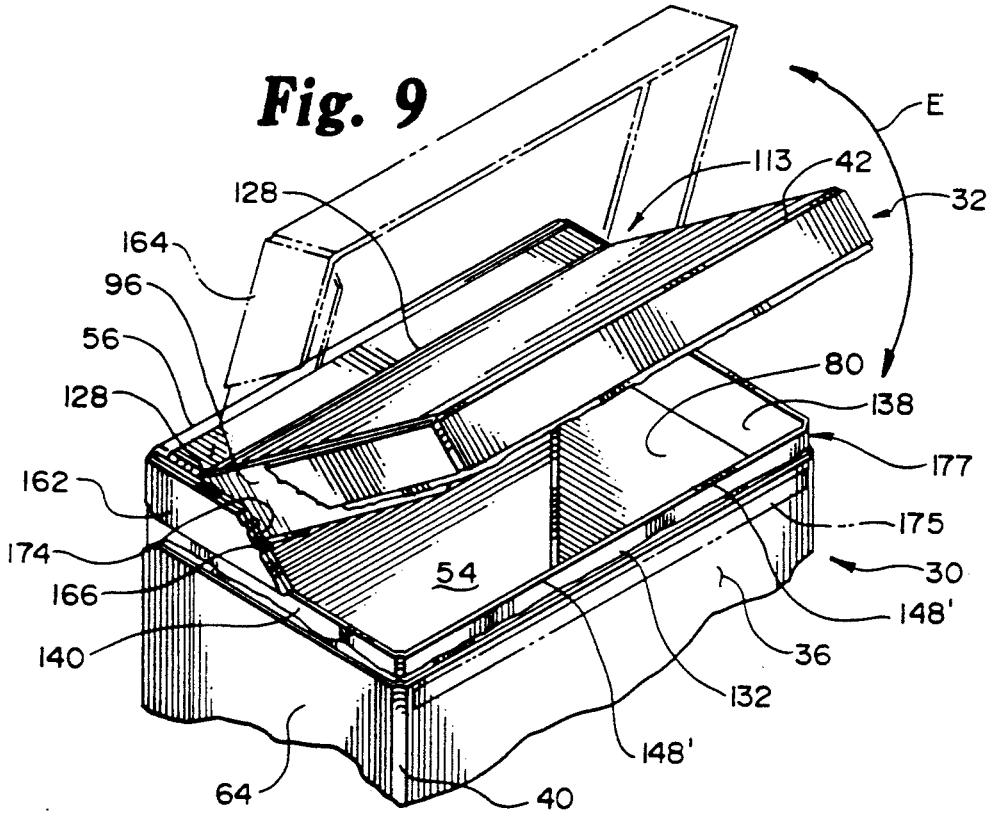
FIG. 9 is a perspective view of another step in the opening of the carton embodiment of FIG. 1 and depicts the range of motion of the hooded carton lid.

Referring to FIG. 7, the arrangement of the sides of the hood or top 32 of the carton 30, particularly the side of the hood skirt 156, is depicted. One particular advantage of the present invention is that the floating retaining wall panels 138, 140 (138 is depicted), as well as the retaining wall panel 132, extend past the edges of tear strip 150, both upwardly above and downwardly below the tear strip 150. Thus, when opened, as depicted in FIG. 9, the retaining wall panel 132 and floating sides 138, 140 provide a solid, secure upstanding lip 177 around the front and sides of the opening into the carton interior. The lip 177 helps retain the hood 32 in place when reclosed, and helps prevent contents from spilling. Another advantage of the present invention is that the side skirt portions 156 of the hood end 32 of carton 30 are substantially reinforced by the multiple layers depicted in FIG. 7, particularly in the hinge region 178 of the top 32.

Figure 8:
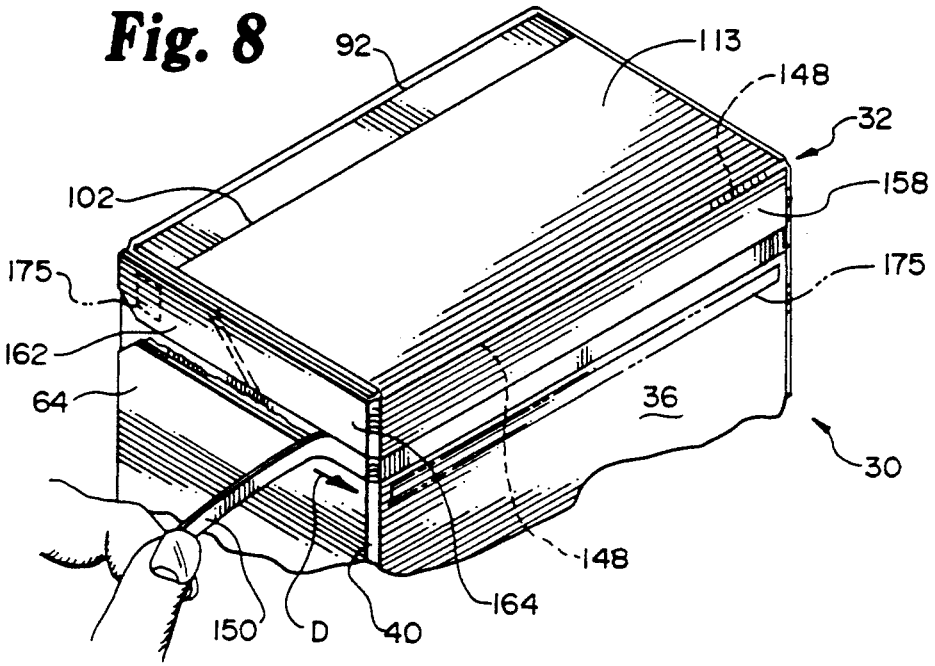
FIG. 8 is a perspective view depicting an initial step in the opening of the carton embodiment of FIG. 1.

FIGS. 8 and 9 depict opening the carton 30 of the present invention. A user grasps either end 152 of the tear strip 150 and pulls outwardly along the tear strip 150 (in the direction of arrow D, or the opposite direction, depending on which tab end 152 is used to begin removing the tear strip 150), tearing the strip 150 free along the cut lines forming it. The tear strip 150 is removed entirely and disposed of. After the tear strip 150 is removed, the hood 32 is free for a range of motion, depicted by arrow E and phantom positions in FIG. 9. The retaining wall panel 132 is fixed adhesively to the front wall 36 of the carton 30 beneath the tear line 150 to form the lip 177 extending around the carton opening. The hood 32 is free to rotate about the hinge cut line 128 which is in closely adjacent, underlying, parallel relationship with the cut line 102. Sequentially, after the tear strip 150 is removed, pressure exerted in the upward direction along arrow E initially frees the hood 32 from the retaining wall panel 132, originally connected thereto at hinges 148 in the umbilical region 134, shown broken at 148' in FIG. 9. Continued lifting causes aligned weakened cut lines 104, 166, 174 to tear, freeing the hood 32 for manipulation about the hinge line 128. The delamination areas 130, the flange 126, the retaining wall 132, the hood stops 162 and the lip 177 provide a hood stop function and help to hold the hood 32 frictionally closed after reclosing to prevent the contents from spilling or being contaminated.

Figure 10:
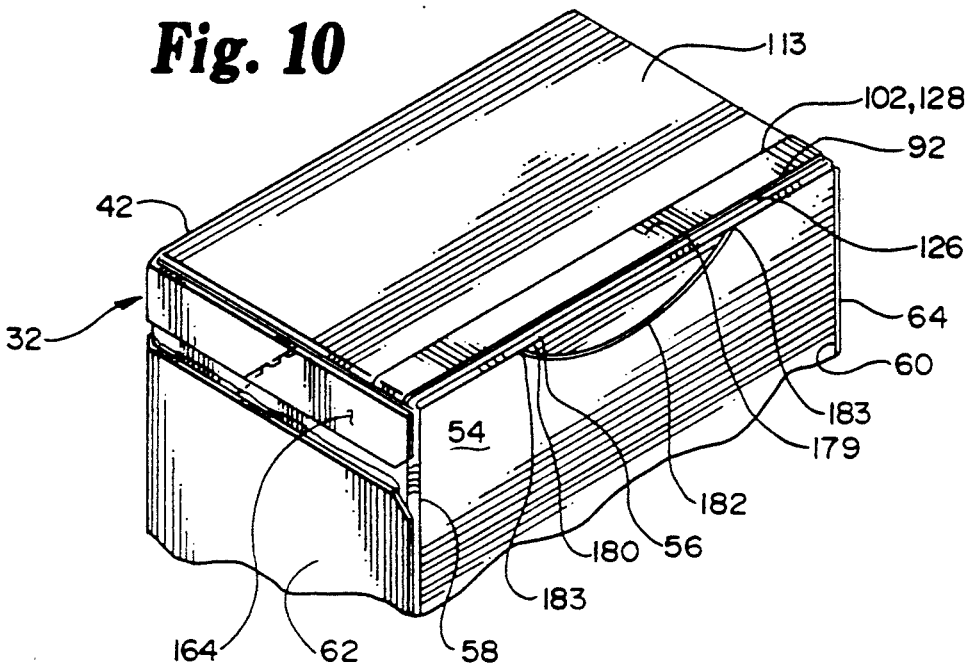
FIG. 10 is a perspective view of the present invention depicting the handle relief crescent in the rear wall of the carton embodiment of FIG. 1.
Figure 11:
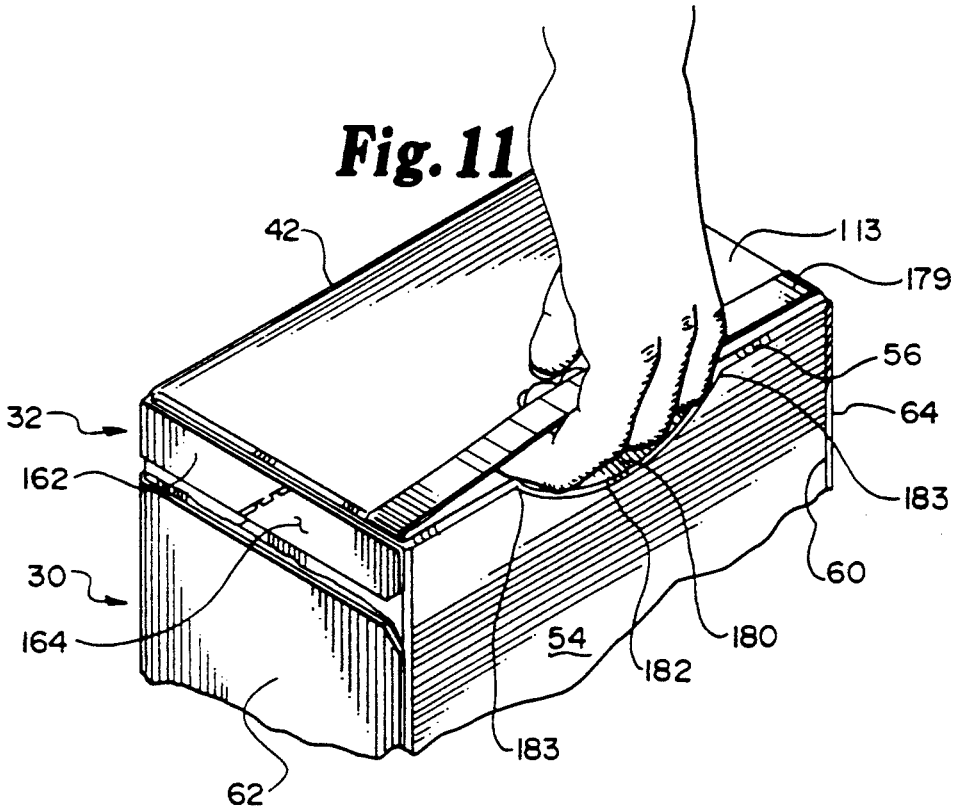
FIG. 11 is a perspective view depicting the handle of the carton embodiment of FIG. 1 in use.
Figure 12:
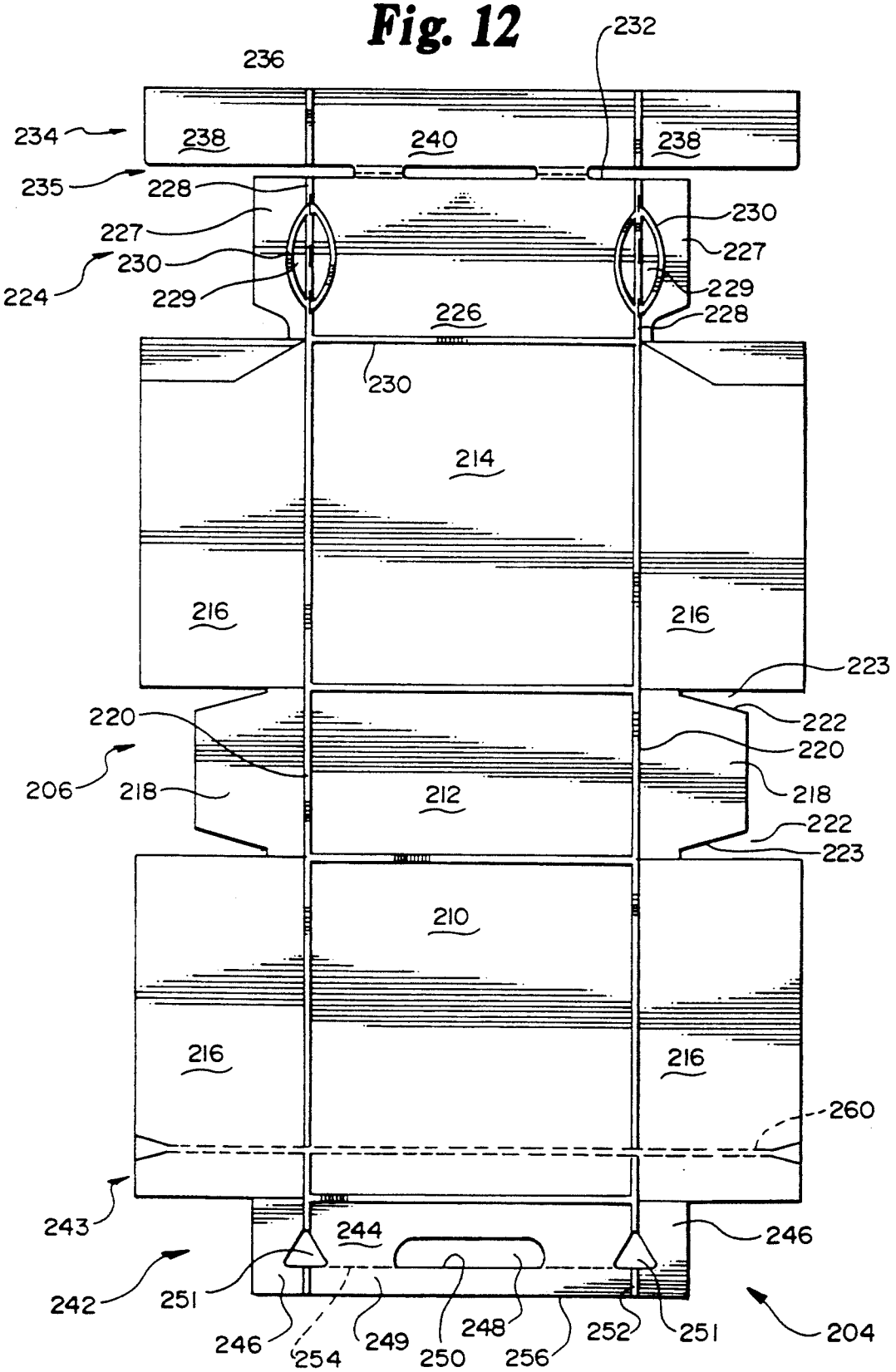
FIG. 12 is a top plan view of the inside surface of a second embodiment of the blank of the present invention for forming a second embodiment of the carton of the present invention, and depicts the die-cut profile thereof.

FIGS. 9, 10 and 11 depict another advantage of the present invention. Specifically, the cut line 102 and free edge 92 of the outermost top hood panel 90 form an integral handle 179 that can be used even after the hood 32 is opened and closed as depicted in FIGS. 8 and 9. Folding the blank 34 as described above causes the cut line 102 to become aligned with hinge line 128. Thus, the handle 179, formed of the strip of the central panel 90 between the free edge 92 and the cut line 102, is immediately outside and overlying the hinge flange area 126, adjacent the rear edge of the outermost top wall 113 (comprised of overlaid and connected panels 90, 112) of the carton 30. The outside hood panel 90 and the inside hood panel 112 are secured together by adhesive immediately adjacent the hood flange area 126 and in the umbilical region 134; however, no adhesive is applied between the handle 179 and the outside of the flange area 126. Therefore, the purchaser of a product contained in the carton 30 of the present invention may use the handle 179 to carry or move the carton 30 even after the recloseable hood 32 is opened.

As depicted in FIGS. 1 and 11, the rear wall panel 54 of the blank 34 (and thus, the rear wall 54 of the carton 30) of the present invention includes a deformable generally crescent-shaped region 180 formed by a curved scored fold line 182, the ends 183 of which intersect the fold line 56. The deformable crescent 180 enables the rear wall 54 to collapse or be depressed sufficiently inwardly toward the interior of the carton 30 to facilitate the insertion of a user's fingers under the handle 179 as depicted in FIG. 11. The handle 179 may be reinforced with a strip of appropriate material applied to either the inside or outside of the handle 179, specifically to either the inside or outside surface of the strip of the central panel 90 between the free edge 92 and the cut line 102 (not shown in FIG. 11, but see FIG. 14).

Figure 13:
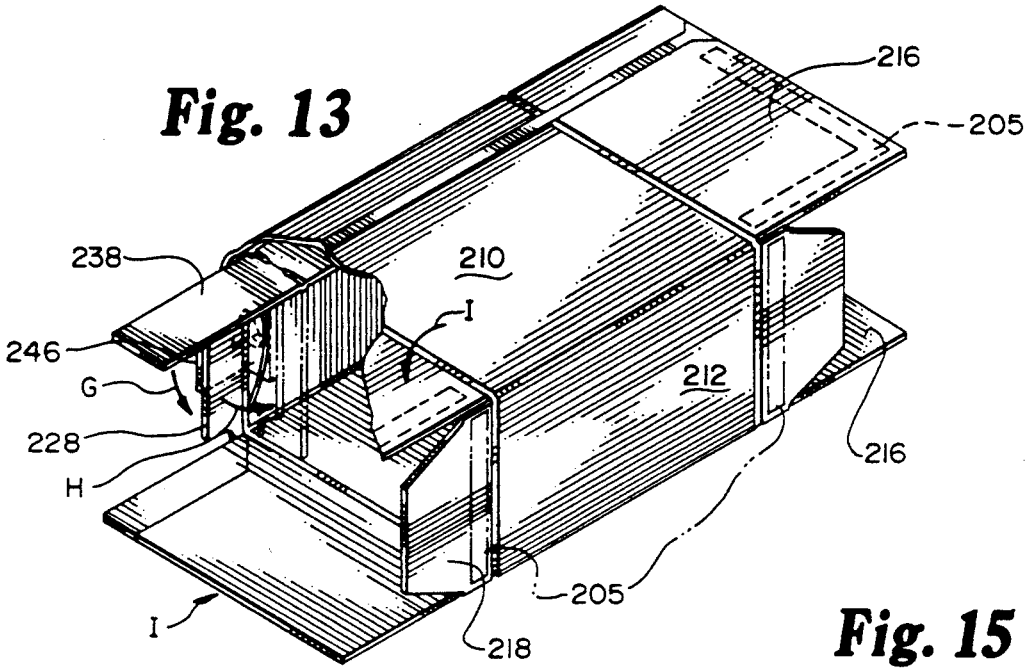
FIG. 13 is a perspective view, with parts cut away, of the second embodiment blank partially erected.
Figure 14:
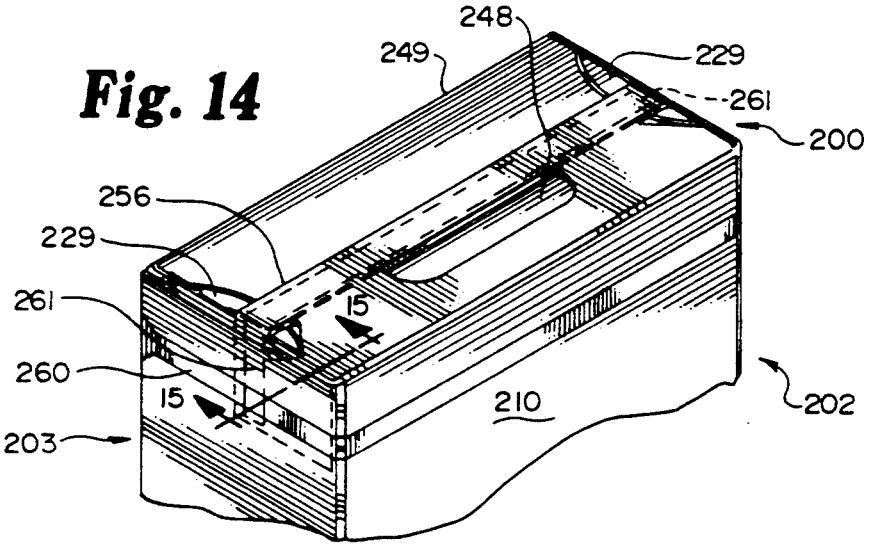
FIG. 14 is a perspective view of the second embodiment carton depicting the handle assembly thereof.
Figure 16:
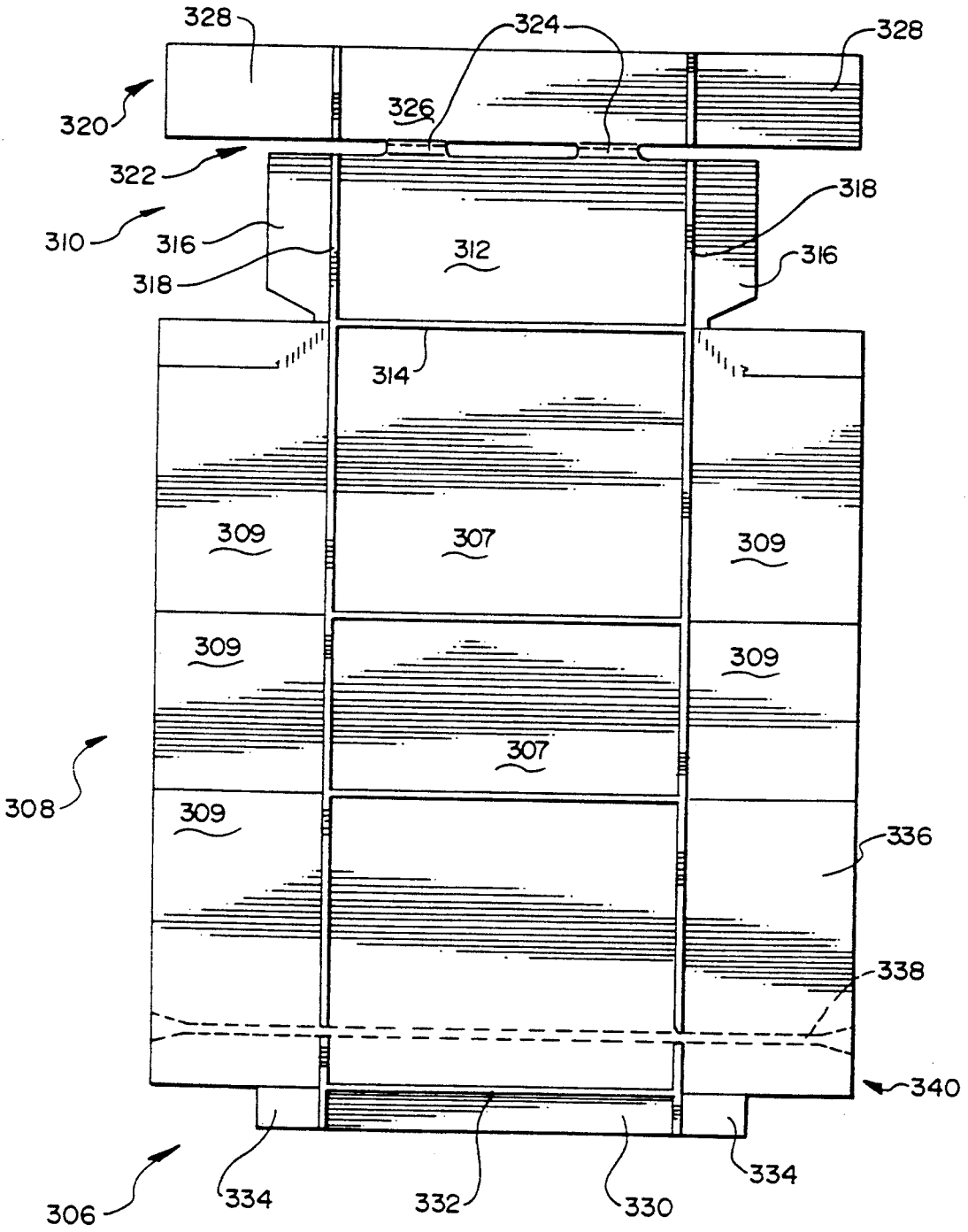
FIG. 16 is a top plan view of the inside surface of a third embodiment of the blank of the present invention for forming a third embodiment of the carton of the present invention, and depicts the die-cut profile thereof.

FIGS. 12–15 depict a second embodiment 202 of the carton according to the present invention. FIG. 14 depicts the hooded top end 200 of the second embodiment carton 202. The carton 202 is formed by folding up the blank 204 depicted in FIG. 12. The blank 204 is generally similar to the blank 34 (depicted in FIG. 1), including a generally central portion 206 comprising a plurality of foldably connected carton body forming panels including front, bottom, rear and major side forming panels 210, 212, 214, 216, respectively. Minor side forming flaps 218 are foldably connected along fold lines 220 to each side of the bottom panel 212. The minor side forming flaps 218 include angled cut free edges 222 that create relieved areas 223 between the flaps 218 and major panels 216 to facilitate folding the blank 204 into the second embodiment of the carton 202 of the present invention.

An inside hood forming group 224 is foldably connected to the rear wall panel 214. The group 224 includes a generally central, inside hood panel 226 and two hood flaps 227. The flaps 227 are foldably connected to each side of panel 226 a along perforated fold score lines 228 which are generally perpendicular to fold line 230. At the substantially free edge 232 of the inside panel 226, a retaining wall group 234 is connected to the panel 226 at an umbilical region 235 by a pair of perforated, folding or articulating, two one-sided hinge scores 236. A side retaining wall flap 238 is foldably coupled to a central retaining wall panel 240 at each side thereof.

An outside hood group 242, including a hood skirt forming part 243, is foldably connected to the opposite end of the generally central portion 206 of the blank 204. The outside hood group 242 includes an outside, overlying, generally central hood panel 244 and a pair of outside hood skirt forming flaps 246 foldably connected to each of side of the central panel 244. The central panel 244 includes a central generally oblong opening 248 with a continuous peripheral edge 250, and two generally triangular stripped out areas 251, the stripped out areas 251 being generally aligned with and centered on the fold lines 252 at which the flaps 246 are foldably connected to the central panel 244. A perforated or cut line of weakness 254 is formed in the central panel 244 and is spaced from and parallel to the free edge 256 of the central panel 244. A portion of the line 254 is collinear with the edge 250 of the opening 248.

The carton 202 of the second embodiment is provided with a tear strip 260 that is substantially similar to the tear strip 150 of the previously described embodiment (FIG. 1).

The inside hood group 224, specifically the center panel 226 and the flaps 227 foldably connected thereto, include bilateral elliptical regions 229 formed by curved, mirror image, fold score lines 230. The regions 229 are generally centered on the side edges of the central inside hood forming panel 226.

The erection or fold up sequence of the carton 202 is substantially similar to that described with reference to the first embodiment. That is, the blank 204 is tubed and the side forming panels and flaps are folded sequentially to form the sides 203 of the carton 202 as depicted in FIG. 13. Specifically, the floating retaining wall flaps 238 are folded in first in the direction of arrow G. Next, the inside hood skirt forming flaps 227 and 246, which are adhered to each other, are folded in the direction of arrow H. Then, panels 218 are folded inwardly and, finally, the two major outside side forming panels 216 may be folded inwardly (arrow I) until a multi-layered side wall 203 is formed at both sides of the carton 202. The formed side walls 203 are generally orthogonal with respect to the front and rear walls 210, 214 of the carton 202. The retaining wall flaps 238 are not adhered to any other side wall forming component, but the remainder of the side wall forming flaps and panels are connected to each other by an appropriate adhesive, as at adhesive areas 205.

Figure 15:
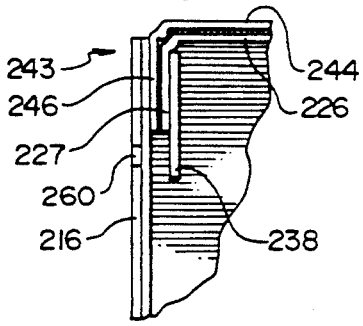
FIG. 15 is a sectional view taken along line 15—15 of FIG. 14.

FIGS. 14 and 15 depict the erected, closed carton 202 and, more particularly, the upper hooded end 200 thereof. An advantage of the second embodiment carton 202 is depicted in FIG. 14. The opening 248 permits a consumer to free the handle strip 249 and to carry the carton 202 away from the place of purchase prior to opening. Another advantage, particularly associated with the elliptical depressible or deformable regions 229, is that as the carton 202 is lifted and the handle strip 249 pulls away from the central portion of the hood top end 200, particularly the opening 248, the elliptical regions 229 permit the rounding of the side edges of the top of the carton 202 for durability purposes. A plastic or fiber reinforcing strip 261 (depicted in phantom in FIG. 14) may be applied to the underside or to the exposed outside surface of the handle 249.

FIG. 15 depicts the reinforcing layering at the sides of the skirt part 243 of the carton 202 and discloses advantages thereof. Specifically, the central retaining wall panel 240 is fixed to the front wall 210 under the tear strip 260, and the floating retaining wall flaps 238 extend downwardly past the tear strip 260 as well. Together the retaining wall panel and the side flaps 240, 238, respectively, form an upstanding retaining wall whereby, after opening, the carton 202 can be substantially and securely reclosed to protect the contents.

Figure 17:
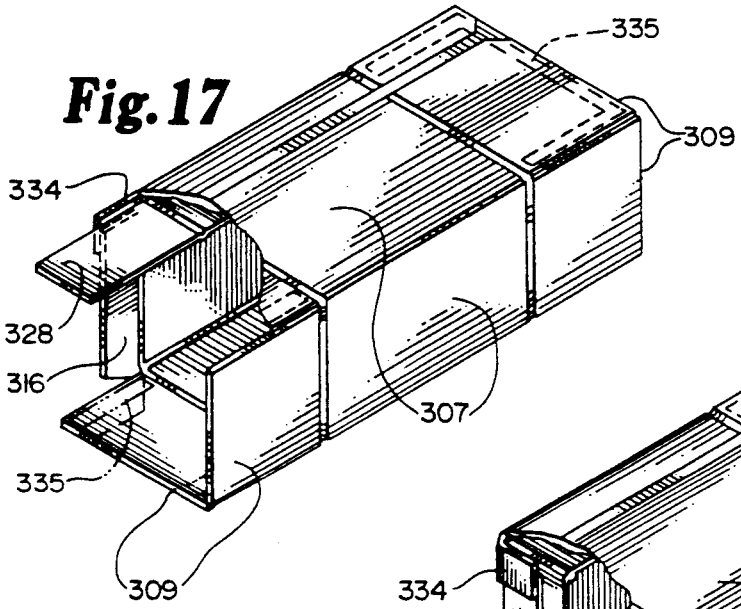
FIG. 17 is a perspective view, with parts cut away, of the third embodiment blank partially erected.
Figure 18:
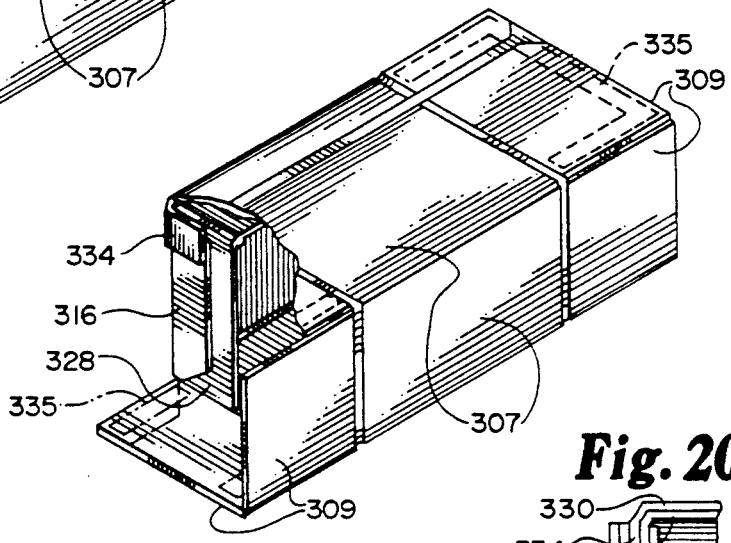
FIG. 18 is a perspective view with parts cut away, of the third embodiment depicting the folding of the side closure panels.
Figure 19:
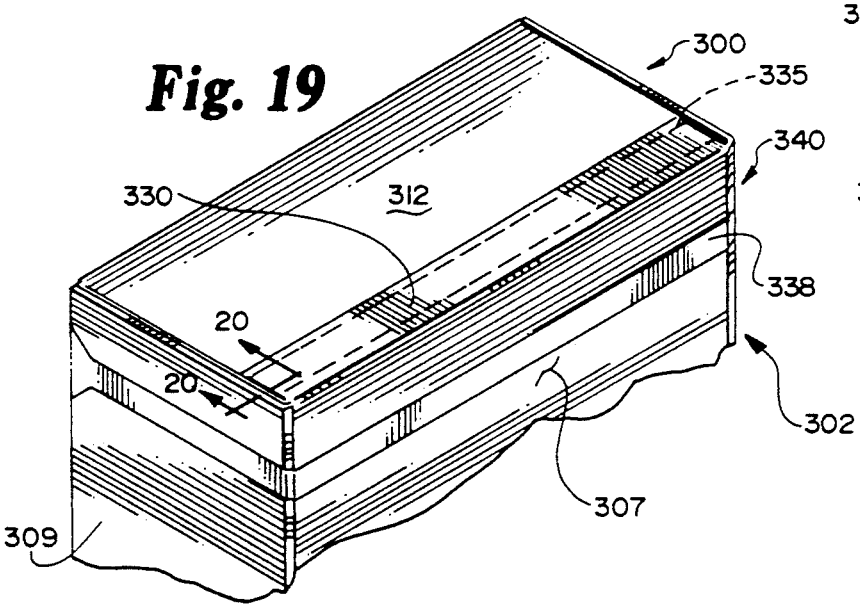
FIG. 19 is a perspective view of the third embodiment showing the hood thereof.

FIGS. 16–20 depict a third embodiment, handleless carton 302 having a hood with at least some multiple layer portions according to the present invention. In particular, FIG. 19 depicts the top end 300 of the carton 302. The carton 302 is formed by foldably erecting the blank 306 depicted in FIG. 16. The blank 306 is generally similar to the blanks 34 and 204 (depicted in FIGS. 1 and 12, respectively), including a generally central portion 308. The central portion 308 is substantially similar to the central portion of the blanks 32, 34, including central wall panels 307 and side forming panels 309. At one end of the central portion 308, the blank 306 includes an inside hood group 310. The inside group 310 includes an innermost central panel 312 foldably connected to the central portion 308 along fold line 314 and a pair of skirt forming flaps 316 connected to the panel 312 along fold lines 318. A retaining wall group 320 is connected to the central panel 312 at an umbilical region 322. The umbilical region 322 includes a pair of frangible, two one-sided, cut and scored hinges 324 connecting a central retaining panel 326 to the panel 312. A pair of floating side flaps 328 are foldably connected to the central retaining panel 326.

At the opposite end of the central portion 308, the blank 306 includes an outermost hood gluing panel 330 foldably connected along fold line 332 to the central portion 308. At each side of the gluing panel 330 is a glue tab 334.

Figure 20:
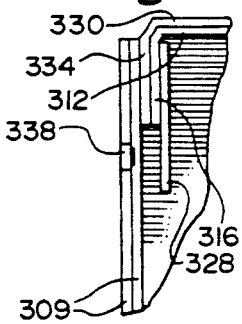
FIG. 20 is a sectional view taken along line 20—20 of FIG. 19.

FIGS. 17 and 18 depict the fold-up sequence of the blank 306 into the carton 302. The blank 306 is tubed (FIG. 17) and then the floating retaining wall panels 328 are folded inwardly and downwardly. The flaps 316 and the tabs 334 which are adhered together are folded inwardly and downwardly to overlie the floating panels 328. Next, the side panels 309 of the central group 308 are folded inwardly. Finally, the two major flaps are folded and adhered with the side panels carrying the opening tear strip 338 being outermost as depicted in FIG. 19. Advantages of the third embodiment are similar to that of previously described two embodiments in that the hood skirt region 340, particularly the sides thereof, are reinforced by the overlaid side forming tabs, flaps and panels and, as depicted in FIG. 20, the floating retaining wall flaps 328 (and the central panel 326) extend downwardly below and upwardly above the tear strip 338 (contacting the inside of the hood or top end 300 of the carton 302) so that the carton 302 can be substantially sealed before opening and reclosed to protect the contents.

Figure 21A:
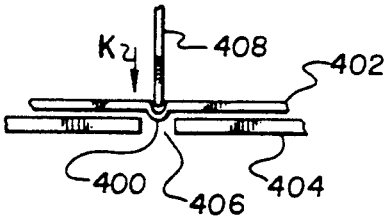
Fig. 21a PRIOR ART
FIG. 21*a* is an elevational view representing the formation of prior art fold score lines.
Figure 21B:
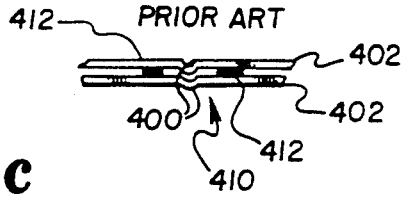
Fig. 21b PRIOR ART
FIG. 21*b* is an elevational view representing overlying prior art fold score lines.
Figure 21C:
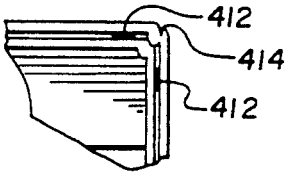
Fig. 21c PRIOR ART
FIG. 21*c* is a sectional view representing the folding of the overlaid prior art score lines depicted in FIG. 21*b*, and the effect of folding such score lines.
Figure 22A:
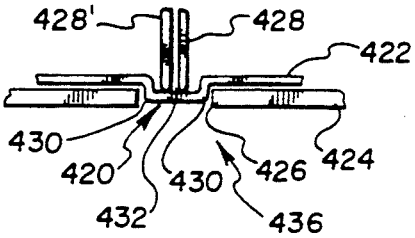
FIG. 22*a* is an elevational view representing the fold score line of the present invention, and the procedure for using two one-sided score lines for forming such a fold score line.

FIGS. 22*a–c* and 23 depict another feature of the cartons 30, 202, 302 of the present invention. To more clearly understand this feature of the invention, FIGS. 21*a–c* show prior art score lines for overlaid layers. Specifically, FIG. 21*a* shows the formation of a prior art score line 400 in the stock material 402. To form this score line 400, a piece of stock material 402 is positioned above a plate member 404 having a relieved area 406. An appropriately shaped scoring rule instrument 408 is forced downwardly in the direction of arrow K to contact the stock material 402 and force it into the relieved area 406.

FIG. 21*b* depicts two pieces of scored stock material 402, each scored by prior art score lines 400, adhered together by adhesive areas 412. The lines 400 are overlaid between the adhesive area 412. FIG. 21*c* depicts the problem caused when a pair of prior art score lines 400, positioned as in FIG. 21*b*, is folded or articulated to form a corner, as in a corner of a carton. Specifically, because of the adhesive regions 412 on each side of the score lines 400, a rupture or crack 414 is formed when the overlaid pair of score lines 400 is articulated to form a 90° corner as depicted in FIG. 21*c*. The rupture 414 is formed because the sheets of stock material 402 cannot slide relative to each other. Therefore, the outermost score 400 has no room to expand inwardly and ruptures outwardly.

Figure 23:
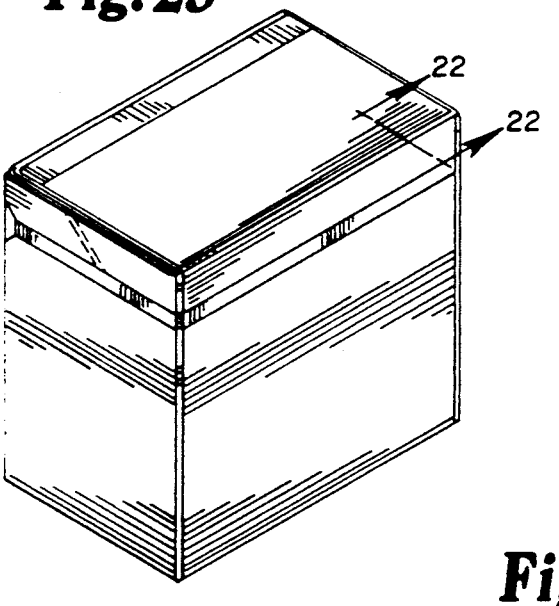
FIG. 23 is a perspective view of the carton of the present invention including the two-sided score line of the present invention along the top front leading edge of the hood for the carton.
Figure 22B:
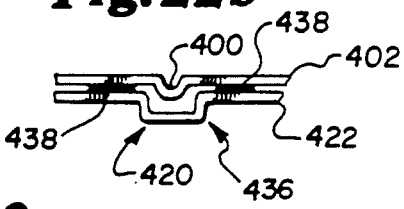
FIG. 22*b* is an elevational view representing the alignment overlying of the score line of the present invention and a prior art single scored fold score line.
Figure 22C:
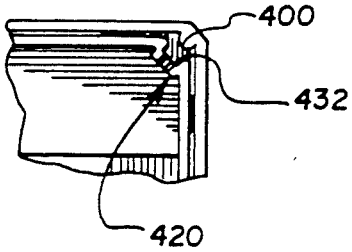
FIG. 22*c* is a sectional view taken along line 22*c*—22*c* of FIG. 23 which depicts the folding of the overlaid score lines shown in FIG. 22*b;*
Figure 22D:
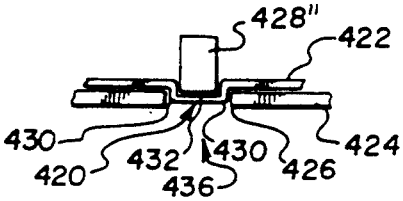
FIG. 22*d* is an elevational view representing an alternative score rule and method for forming the fold score line of the present invention.

The problem depicted in FIG. 21*c* is avoided in the cartons (30, 202, 302) of the present invention by providing a two or double one-sided score 420, as depicted in FIG. 22*c*. The two one-sided score 420 of the present invention finds particular use in the umbilical region (134, 235, 322) of the cartons 30, 202, 302 of the present invention as represented in FIG. 23. Specifically, with reference to FIGS. 22*a* and 22*b*, a sheet of stock material 422 is positioned above a plate member 424 having a relatively wider relieved area 426 than the plate member 404 depicted in FIG. 21*a*. A pair of appropriate scoring rules or instruments 428 and 428' are used to form two corners 430 close enough together to form a displaced central region 432, thereby forming a two one-sided score line 420 which is wider than the single score line 400 using prior art techniques. The two one-sided score line 420 will generally be greater than 1.5 times or from 1.5 to 3 times wider than a typical score line 400, but it should be appreciated that the selected width relates to the thickness of the stock material 402 being scored and folded and, therefore, the width of the score line 420 may be varied accordingly. Instead of using two rules 428, 428', the wider score line of the present invention may be formed by using a single wide rule 428'' as depicted in FIG. 22*d*. Other appropriate methods and tools for producing a wide score line may be used as well.

The present invention contemplates overlaid score lines 400, 420 being used to form an articulation joining two paperboard members as shown in FIG. 22*b*. A prior art single-sided score 400 in a piece of stock material 402 is aligned with and outside the relatively wider two one-sided score 420 of the present invention in stock material 422. The two pieces of stock material 402 are adhesively adjoined at each side of the aligned scores 400, 420 at adhesive regions 438. More specifically, the method of forming the score lines in a double or multiple layer structure includes forming a first score line 400 in one of the layers of stock material 402, forming a second score line 420 of increased width relative to the first line 400 in a second layer of stock material 402, and connecting the layers so that the first and second score lines 400, 420, respectively, are aligned or overlay one another as shown in FIG. 22*b*.

FIG. 22*c* depicts the advantage of the wider, two one-sided fold score line 420 of the present invention, particularly when contrasted with FIG. 21*c* depicting overlaid score lines 400 of the prior art. Specifically, when the overlaid score lines 400, 420 are folded, the displaced region 432 permits the inward expansion of the prior art single-side score line 400, preventing the rupture 414 depicted in FIG. 21*c*. While the two one-sided score 420 of the present invention is depicted in the umbilical regions 134, 235, 322 of the cartons 30, 202, 302, respectively, particularly to form the hinges 148, 236, 324, respectively, it may be used wherever aligned, overlapping or overlaid fold score lines are found. The double-sided fold score 420 of the present invention finds particular utility where articulated, foldable double thickness walls are required and where durability and sift-proofness of cartons is a desired attribute.

The present invention may be embodied in other specific forms without departing from the spirit or essential attributes thereof. It is therefore desired that the present embodiment be considered in all respects as illustrative and not restrictive, reference being made to the appended claims rather than to the foregoing descriptions to indicate the scope of the invention.

What is claimed is:

1. A carton comprising:

front and rear walls, said front and rear walls each having a top edge;

a bottom wall panel;

opposed side walls extending between and connected with said front and rear walls;

a top wall structure including a recloseable foldable hood comprising an outer hood panel foldably connected to the front wall, an inside hood panel underlying the outer hood panel and foldably connected to the rear wall, and a hood skirt foldably connected to said hood and releasably connected to said front and side walls; and a retaining wall secured to said front wall, a portion of said retaining wall extending above the top edge of said front wall after said carton is opened, wherein said retaining wall is formed by a front retaining wall panel and two opposed side retaining wall panels foldably carried by said front retaining wall panel, said front retaining wall panel being secured to the front wall and being releasably connected to said inside hood panel.

2. The carton according to claim 1, said hood skirt defined by hood side flaps and a portion of said front wall, said hood side flaps each being foldably connected to said outer hood panel along a respective fold line generally perpendicular to the foldable connection between the outer hood panel and the front wall, said portion of said front wall foldably connected to said outer hood panel and releasably connected to said front wall, said hood side flaps being releasably connected to said side walls.

3. The carton according to claim 2, said front retaining wall panel being releasably connected to said inside hood panel at an articulation comprising overlaid score lines including a first score line and a wider second score line including a generally central displaced region for receiving a portion of said first score line when said articulation is articulated.

4. The carton according to claim 3 and two flange tabs foldably connected to said inside hood panel adjacent to said rear wall.

5. The carton according to claim 1, wherein said outer hood panel has a free edge parallel to the foldable connection between said outer hood panel and said front wall, said carton including an integral handle comprising a portion of said outer hood panel defined by a cut line, said cut line generally parallel to said free edge and between said free edge and the foldable connection between said outer hood panel and front wall, extending across said outer hood panel and defining a handle strip.

6. The carton according to claim 5, said integral handle further comprising a handle flange underlying said handle strip, said handle flange defined by a hinge cut line partially cut through said inside hood panel, said hinge cut line being generally parallel to the foldable connection between said inside hood panel and rear wall and extending substantially across said inside hood panel, and a delamination area at each end of said hinge cut line.

7. The carton according to claim 6, wherein said cut line in said outer hood panel substantially overlies said hinge cut line.

8. The carton according to claim 7, wherein said hinge cut line and said delamination areas comprise a hood hinge.

9. The carton according to claim 2, wherein said outer hood panel has a free edge opposite and generally parallel to the foldable connection between said outer hood panel and said front wall, said outer hood panel partially overlying said inside hood panel and having a generally central finger-receiving opening with a peripheral edge and a handle strip between said free edge and said opening.

10. The carton according to claim 9, said handle strip being defined by said free edge and a cut line parallel to said free edge, at least a portion of said cut line being collinear with the peripheral edge of said opening.

11. The carton according to claim 10, wherein said inside hood panel includes two side edges defined by fold lines generally perpendicular to the foldable connection between said inside hood panel and said rear wall, and a deformable region at each said side edge, said deformable regions underlying said handle strip.

12. A single-piece of stock material provided with cuts and scores for forming a carton blank, said blank comprising:

a generally central portion including a plurality of foldably connected carton body forming panels and having a first end and a second end;

an inside hood panel foldably connected to said first end;

an outside hood panel foldably connected to said second end; and retaining wall panels foldably and releasably connected to said inside hood panel, said scores comprising a plurality of fold score lines for forming said foldable connections, at least a portion of said fold score lines adapted to be overlaid, including an overlying score and an underlying score wider than said overlying score, said underlying score aligned with and under said overlying score.

13. A foldable joint facilitating the folding of first and second members, said joint comprising overlaid score lines including a first score line and a second score line, formed in said first and second members, respectively, said second score line being wider than said first score line, underlying said first score line and including a displaced area for receiving a portion of said first score line when said joint is folded.

14. The joint according to claim 13, wherein said first and second members are secured to each other on each side of said joint.

15. The joint according to claim 13, wherein said displaced region is wider than said first score line.

16. The joint according to claim 15, wherein said displaced region is at least 1.5 times wider than said first score line.

17. The joint of claim 13, wherein said first and second members comprise first and second planar members of paper board stock, each of said first and second planar members having an outward planar surface and an inward planar surface with the inward planar surface of said first member in close adjacent relationship with the outward planar surface of said second member, and each of said score lines comprising a linear recessed area formed in and recessed relative to said outward planar surface and an opposed linear displaced area formed in and extending outwardly relative to said inner planar surface, said recessed area and opposed displaced area of said second score line being wider than the recessed area and opposed displaced area of said first score line.

18. The joint of claim 17 facilitating the folding of said first and second members such that portions of said inward planar surfaces of each of said first and second members form an angle relative to one another of less than 180°.

19. The joint of claim 18 consisting essentially of a pair of first and second planar members.

20. The joint of claim 18 being foldable in a single, predetermined direction.

21. A carton comprising:

front and rear walls each having a top edge;

a bottom wall formed by a panel foldably connected to said front and rear walls;

opposed side walls extending between and connected with said front and rear walls;

a top wall structure including a recloseable, foldable hood comprising:

an outer hood panel foldably connected to said front wall and having a free edge parallel to the foldable connection between said outer hood panel and said front wall, said outer hood panel carrying a cut line parallel to said free edge and closer to said free edge than to said foldable connection between said outer hood panel and said front wall, said cut line defining a handle strip;

an inside hood panel foldably connected to the rear wall and underlying said outer hood panel; and a hood skirt foldably connected to said hood and releasably connected to said front and side walls, said hood skirt including hood side flaps and a portion of said front wall, each said hood side flap being foldably connected to said outer hood panel along a fold line generally perpendicular to the foldable connection between the outer hood panel and the front wall and releasably connected to one of said side walls, said portion of said front wall foldably connected to said outer hood panel and releasably connected to said front wall; and a retaining wall secured to said front wall, a portion of said retaining wall extending above the top edge of said front wall after the carton is opened, said retaining wall being formed by a front retaining wall panel and two side retaining wall panels foldably carried by said front retaining wall panel, said front retaining wall panel being releasably connected to said inside hood panel before the carton is opened.

22. A carton comprising:

front and rear walls, said front and rear walls each having a top edge;

a bottom wall panel;

opposed side walls extending between and connected with said front and rear walls; and a top wall structure including a recloseable hood pivoted along an axis parallel to and spaced forwardly from the top edge of said rear wall, wherein said recloseable hood comprises:

an outer hood panel foldably connected to the front wall;

an inside hood panel foldably connected to the rear wall and underlying the outer hood panel; and a hood skirt foldably connected to said hood and releasably connected to said front and side walls.

23. The carton according to claim 22, wherein said outer hood panel has a free edge parallel to the foldable connection between said outer hood panel and said front wall, said carton including an integral handle comprising a portion of said outer hood panel defined by a cut line, said cut line generally parallel to said free edge and between said free edge and the foldable connection between said outer hood panel and front wall, extending across said outer hood panel and defining a handle strip.

24. The carton according to claim 23, said integral handle being adjacent to said rear wall.

25. The carton according to claim 23, said integral handle further comprising a handle flange underlying said handle strip, said handle flange defined by a hinge cut line partially cut through said inside hood panel, said hinge cut line being generally parallel to the foldable connection between said inside hood panel and rear wall and extending substantially across said inside hood panel, and a delamination area at each end of said hinge cut line.

26. The carton according to claim 25, wherein said cut line in said outer hood panel substantially overlies said hinge cut line.

27. The carton according to claim 26, wherein said hinge cut line and said delamination areas comprise a hood hinge.

28. A carton comprising:

front and rear walls, said front and rear walls each having a top edge;

a bottom wall panel;

opposed side walls extending between and connected with said front and rear walls;

a top wall structure including a recloseable hood comprising an outer hood panel foldably connected to the front wall, an inside hood panel foldably connected to the rear wall and underlying the outer hood panel, and a hood skirt foldably connected to said hood and releasably connected to said front and side walls; and an integral handle formed in said top wall structure generally adjacent to the top edge of said rear wall.

29. The carton according to claim 28, wherein said outer hood panel has a free edge opposite and generally parallel to the foldable connection between said outer hood panel and said front wall, and a single cut line parallel to said free edge, said cut line defining said integral handle.

30. The carton according to claim 29 and a generally central finger-receiving opening in said outer hood panel, said opening having a peripheral edge.

31. The carton according to claim 30, said integral handle comprising an area of said outer hood panel between said free edge and said cut line parallel to said free edge, at least a portion of said cut line being collinear with the peripheral edge of said opening.

32. The carton according to claim 31, said handle strip being spaced from the foldable connection between said rear wall and said inside hood panel.

33. A single-piece blank provided with cuts and scores for forming a carton, said blank comprising:

a generally central portion including a plurality of foldably connected carton body forming panels and having a first end and a second end;

a first group of top wall forming panels foldably connected to said first end, including an inside hood panel foldably connected to said first end;

a second group of top wall forming panels foldably connected to said second end, including an outer hood forming panel foldably connected to said second end, said outer hood forming panel designed to at least partially overlie said inside hood forming panel when said carton is formed;

means for forming an integral handle, said means associated with said first and second group of top wall forming panels; and retaining wall panels foldably and releasably connected to said inside hood panel.

34. The blank according to claim 33, wherein said means for forming an integral handle includes a cut line in said outer hood forming panel and a handle flange formed in said inside hood forming panel, said cut line defining a handle strip overlying said flange when said carton is formed.

35. The blank according to claim 33 and a generally central, finger-receiving opening in said outer hood forming panel.

36. A carton comprising:

front and rear walls each having a top edge;

a bottom wall panel;

opposed side walls extending between and connected with said front and rear walls;

a top wall structure including a recloseable foldable hood comprising an outer hood panel foldably connected to the front wall, an inside hood panel underlying the outer hood panel and foldably connected to the rear wall, and a hood skirt foldably connected to said hood and releasably connected to said front and side walls, said hood skirt defined by hood side flaps and a portion of said front wall, said hood side flaps each being foldably connected to said outer hood panel along a respective fold line generally perpendicular to the foldable connection between the outer hood panel and the front wall, said portion of said front wall foldably connected to said outer hood panel and releasably connected to said front wall, said hood side flaps being releasably connected to said side walls; and a retaining wall secured to said front wall, a portion of said retaining wall extending above the top edge of said front wall after said carton is opened, wherein said retaining wall is formed by a front retaining wall panel and two opposed side retaining wall panels foldably carried by said front retaining wall panel, said front retaining wall panel being secured to the front wall and being releasably connected to said inside hood panel at an articulation comprising overlaid score lines including a first score line and a wider second score line including a generally central displaced region for receiving a portion of said first score line when said articulation is articulated.

37. The carton according to claim 36, wherein said second score line underlies said first score line.

38. The carton according to claim 36, front retaining wall panel is releasably connected to said inside hood panel along said second score line.

39. The carton according to claim 38, wherein said outer hood panel is foldably connected to said front wall along said first score line and said inside hood panel is releasably connected to said front retaining wall panel along said second score line.

* * * * *